United States Patent [19]

Mulder

[11] Patent Number: 4,730,647

[45] Date of Patent: Mar. 15, 1988

[54] POWDER FEEDER APPARATUS

[75] Inventor: Douglas C. Mulder, Wellington, Ohio

[73] Assignee: Nordson Corporation, Amherst, Ohio

[21] Appl. No.: 939,090

[22] Filed: Dec. 8, 1986

[51] Int. Cl.[4] ..... B65B 1/04; B65B 5/02

[52] U.S. Cl. ..... 141/67; 55/302; 55/473; 98/115.2; 118/308

[58] Field of Search ..... 55/302, 473; 141/67, 141/285–310, 2, 18; 98/115.2; 118/308, 311, 312, 326; 239/3, 15

[56] References Cited

U.S. PATENT DOCUMENTS

| | | | |
|---|---|---|---|
| 3,814,002 | 6/1974 | Rombach et al. | 118/500 |
| 3,960,323 | 6/1976 | Ducan et al. | 239/3 |
| 4,245,551 | 1/1981 | Berkmann | 55/341 R |
| 4,261,713 | 4/1981 | Bourdois et al. | 55/302 |
| 4,354,451 | 10/1982 | Vohringer et al. | 118/326 |
| 4,378,728 | 4/1983 | Berkmann | 55/310 |
| 4,409,009 | 10/1983 | Lissy | 55/302 |
| 4,471,715 | 9/1984 | Gubler et al. | 118/326 |
| 4,498,913 | 2/1985 | Tank et al. | 55/326 |
| 4,543,274 | 9/1985 | Mulder | 427/197 |
| 4,561,380 | 12/1985 | Mulder et al. | 118/688 |
| 4,590,884 | 5/1986 | Kreeger et al. | 118/308 |
| 4,662,309 | 5/1987 | Mulder | 118/312 |

*Primary Examiner*—Houston S. Bell, Jr.
*Attorney, Agent, or Firm*—Wood, Herron & Evans

[57] ABSTRACT

A powder feeder for supplying particulate powder material to powder applicators mounted in a powder spray booth comprises a housing having an inlet connected to the powder recovery system of the powder spray booth, and an outlet. A fluidizing plate and pump or rotating screw feeder is mounted within the interior of the housing to aid in the discharge of particulate powder material through the outlet of the housing to the powder applicators in the spray booth. A clean air chamber mounted to the housing is formed with an inlet communicating with the housing interior and an outlet located outside of the housing which is connected to a source of vacumm. The vacumm source creates a negative pressure within the clean air chamber to draw air from the housing interior to vent its interior. A cartridge filter is mounted within the housing to the inlet of the clean air chamber to prevent airborne particulate powder material from exiting the housing in the course of venting thereof. The cartridge filter is automatically cleaned of collected particulate powder material by a blow back device mounted in the clean air chamber.

10 Claims, 2 Drawing Figures

POWDER FEEDER APPARATUS

BACKGROUND OF THE INVENTION

This invention relates to powder feeding apparatus, and, more particularly, to an apparatus for feeding particulate powder material having a filtered vent.

Particulate powder coating materials are commonly used to coat or paint objects in industrial finishing applications. In such applications, a particulate powder material such as epoxy, polyester or porcelain frit is conveyed to an applicator gun while entrained in an airstream and is sprayed from the nozzle of the gun onto a target surface or a substrate. Conventionally, the target substrate having powder loosely adhered thereto is then heated to melt the powder so that when the melted powder cools, it is permanently adhered to the substrate.

In most applications, powder deposition is performed in a booth which mounts the applicator guns. Articles are moved through the booth on an overhead conveyor and coated with particulate powder material supplied to the applicator guns by a source of air-entrained powder. Oversprayed powder is contained within the booth by an exhaust system and collected in a powder recovery system where it is either held or recirculated back to the applicator guns, generally via a powder feed hopper.

Powder feed hoppers which supply the air-entrained, particulate powder material to the applicator or spray guns contained in the powder spray booth generally comprise a housing having an inlet to receive recirculated, oversprayed powder from the booth, and an outlet connected to a powder pump. In many prior art powder feeders, a fluidized bed is mounted at the base of the housing which is supplied with fluidizing air from a pressurized air source, Powder introduced into the housing through the inlet is received atop the fluidized bed where an upward flow of pressurized air through the fluidizing plate fluidizes the powder in a well known, commercially practiced manner. The powder pump draws the powder from the fluidized bed and entrains the powder within a stream of air. The air-entrained powder is then transmitted to the applicator guns of the powder spray booth for coating the target articles.

The oversprayed powder from the spray booth is recirculated back to the powder feed hopper by a powder pump which entrains the recirculated powder in a stream of air. This air injected with the oversprayed powder into the interior of the housing must be vented to prevent a pressure buildup within the housing. If the pressure in the interior of the housing was allowed to build, the fluidized bed would be rendered inoperative as soon as the internal pressure in the chamber exceeded the pressure of the low pressure airstream moving upwardly through the fluidizing plate.

In the prior art, a hose or pipe has been connected to the housing of the feed hopper to vent its interior. In many instances, the vent pipe has been left open to atmosphere. This has presented environmental problems, however, because the recirculated powder tends to billow or puff up to some extent when injected into the housing so that at least a portion of the powder is suspended within the interior of the housing. At least some of this free floating powder escapes through the vent directly into the atmosphere which can create both health and safety hazards.

In an effort to reduce the hazards caused by direct venting of the housing to atmosphere, a filter has been placed over the vent pipe connected to the housing of the feed hopper. This filter is usually a bag or sock formed of nylon or other woven material having a sufficiently closed weave to capture the powder particles escaping through the vent.

Although the practice of attaching a filitring material to the vent of the housing is preferable to leaving the vent open to atmosphere, prior art filters present a maintenance problem. The bag or sock filter must be periodically removed from the vent and either cleaned or replaced with a new filter. During such maintenance periods, the powder feeder cannot be operated without injecting particulate powder material into the atmosphere.

SUMMARY OF THE INVENTION

It is therefore among the objectives of this invention to provide a powder feeder for supplying particulate powder material to an applicator gun within a powder spray booth which includes a low maintenance, filtered vent to ventilate the interior of the powder feeder without allowing the escape of powder to the atmosphere.

These objectives are accomplished in an apparatus for feeding particulate powder material to powder applicator guns mounted in a powder spray booth which comprises a feed hopper including a housing formed with a hollow interior having an inlet connected to the powder recovery system of a powder spray booth, or an external source of virgin powder, and an outlet spaced from the inlet. A feeder device is mounted within the interior of the housing which is operable to aid in the discharge of particulate powder material through the outlet of the housing to a powder pump for transmittal to the applicator guns. Pressure build-up within the interior of the chamber is eliminated by a venting and filter assembly mounted to the housing having a filtered inlet communicating with the housing interior and an outlet connected to a source of vacuum. The vacuum source is operable to draw air from the interior of the housing which is filtered as it passes through the inlet to the venting and filter assembly. This vents the housing interior and simultaneously filters any airborne particulate powder materials from the vented air.

In one preferred embodiment of this invention, the feeder device comprises a fluidized bed mounted in the interior of the housing of the feed hopper which receives the particulate powder material transmitted through the inlet in the housing. A pressurized stream of air is directed upwardly though the fluidizing plate to form a fluidized bed in which the particulate powder is suspended above the fluidizing plate for discharge through the outlet in the housing interior to an exterior powder pump. In an alternative embodiment, the feeder device comprises an auger or screw feeder mounted within the interior of the housing at the base. Particulate powder material transmitted into the housing interior falls by gravity to the screw feeder which is rotatable to transmit metered quantities of the particulate powder material through the outlet in the housing to an exterior powder pump.

Venting of the interior of the feed hopper housing in both of the embodiments described above is achieved by a clean air chamber mounted to the housing having an inlet communicating with the interior of the housing and an outlet outside of the housing. A source of vacuum is connected to the outlet of the clean air chamber which can take the form of a blower or motor driven fan mounted at the outlet of the clean air chamber, or a separate, external vacuum source connected to the outlet of the clean air chamber. A cartridge filter is mounted within the interior of the housing to the inlet of the clean air chamber, and a blow back device is carried within the clean air chamber above the cartridge filter.

The vacuum source is operable to create a negative pressure within the clean air chamber which draws air within the interior of the housing through the cartridge filter into the clean air chamber. Any particulate powder material which is free floating within the interior of the housing is filtered by the cartridge filter to ensure only filtered air is drawn into the clean air chamber. The blow back device is operated automatically to eject a high pressure stream of air onto the cartridge filter, toward the interior of the housing, to remove collected particulate powder material from the cartridge filter.

The powder feed hopper of this invention is therefore effectively vented without discharging any particulate powder material to the atmosphere. In contrast to the nylon bags or socks mounted to the vent pipes or tubes of prior art powder feeders, the cartridge feeder employed in this invention requires little or no maintenance. The blow back device automatically removes collected impurities from the cartridge filter at periodic intervals. This climinates the regular, manual maintenance required with prior art bag or sock filters.

DESCRIPTION OF THE DRAWINGS

The structure, operation and advantages of the preferred embodiment of this invention will become further apparent upon consideration of the following description taken in conjunction with the accompanying drawings, wherein.

DETAILED DESCRIPITION OF THE INVENTION

Figure 1:
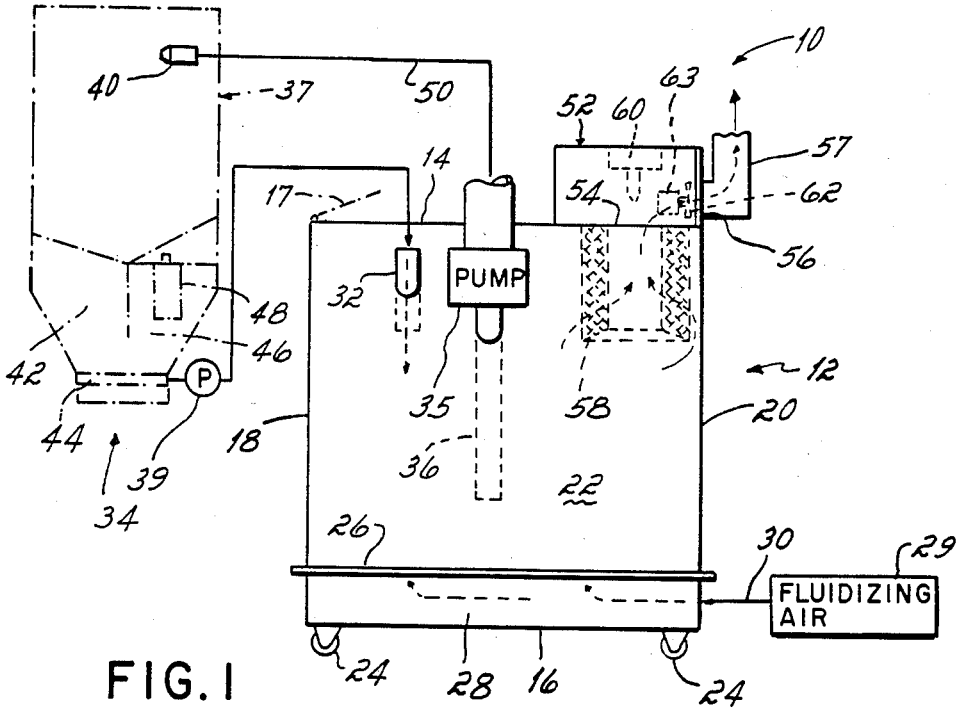
FIG. 1 is a front elevational view of one preferred embodiment of this invention employing a vacuum blower device including a schematic illustration of a powder spray booth.

Referring now to FIG. 1, one embodiment of the powder feeder apparatus of this invention is illustrated. The apparatus 10 comprises a powder feed hopper having a housing 12 formed with a top wall 14, bottom wall 16 and four sidewalls, only two of which, 18 and 20, are illustrated in FIG. 1. Preferably, the top wall 14 is formed with a hinged door 17 to provide an emergency vent in the event of an explosion within the housing 12. The walls 14–20 of housing 12 define a substantially closed interior 22. If desired, rollers 24 are mounted to the bottom wall 16 to allow the housing 12 to be easily transported from place to place.

A fluidizing plate 26 is mounted to the sidewalls 18, 20 within the interior 22 of housing 12. The fluidizing plate 26 is spaced vertically above the bottom wall 16 forming a fluidizing air chamber 28 therebetween which is connected to a pressurized source of air 29 via an air line 30. The air from line 30 is directed upwardly through the fluidizing plate 26 to form a fluidized bed of powder suspended above the fluidizing plate 26.

The housing 12 is formed with an inlet 32 which communicates with the interior 22. As schematically illustrated in FIG. 1, the inlet 32 is connected to a powder recovery system 34 located at the base of a conventional powder spray booth 37 via a powder pump 39. Oversprayed powder from powder applicators 40 mounted in the powder spray booth 37 falls downwardly through a recovery chamber 42 into a fluidized bed 44. Powder not collected in the fluidized bed 44 flows from the recovery chamber 42 to a discharge chamber 46 where a cartridge filter 48 is mounted to filter airborne powder and prevent its escape from the booth 37. Reference should be made to U.S. Pat. No. 4,543,274, for example, for a detailed description of a powder spray booth such as employed with this invention.

The powder pump 39 is operable to transmit air-entrained particulate powder material from the fluidized bed 44 in the powder recovery system 34 of the powder spray booth 37 into the interior 22 of housing 12 through inlet 32. The particulate powder material falls by gravity into the fluidized bed maintained on top of the fluidizing plate 26. A pressurized stream of air from air line 30 enters the fluidizing air chamber 28 beneath the fluidizing plate 26 and flows upwardly therethrough to fluidize the particulate powder material resting atop the fluidizing plate 26. The fluidized powder is then removed from the interior 22 of housing 12 by a powder pump 35 connected to an outlet 36 formed in the housing 14 and communicating with its interior 22. The powder pump 35 is operable to draw the fluidized powder from the fluidizing plate 26 and entrain it within a stream of air for transmittal through a delivery line 50 to the powder applicators 41 mounted in the powder spray booth 37.

In the course of injecting air-entrained particulate powder material into the interior 22 of housing 12 through inlet 32, air pressure builds within the housing interior 22. If this pressure was allowed to exceed the pressure of the air moving upwardly from fluidizing air chamber 28 through the fluidizing plate 26, the powder on the fluidizing plate 26 could not be suspended thereabove making it difficult to discharge from the outlet 36 in housing 12. As a result, the interior 22 of housing 12 must be vented.

Referring to the top righthand portion of FIG. 1, the structure for venting the housing interior 22 is illustrated. Venting is accomplished by a clean air chamber 52 having an inlet 54 communicating with the interior 22 of housing 12 and an outlet 56 disposed outside of housing 12 connected to a vent line 57. A cartridge filter 58 is mounted within the housing interior 22 at the inlet 54 to clean air chamber 52. An air-operated, blow back jet 60 is mounted within clean air chamber 42 in alignment with the inlet 44 and cartridge filter 48.

In the embodiment illustrated in FIG. 1, a fan 62 driven by a motor 63 is mounted within the clean air chamber 52 over the outlet 56 therein. The fan 62 is operable to create a negative pressure within the clean air chamber 52 which draws air from the interior 22 of housing 12 through the cartridge filter 58 and inlet 54 of clean air chamber 52. This vents the housing interior 22 to prevent any pressure buildup therein. In addition, any particulate powder material which is free floating within the housing interior 22 is filtered by the cartridge filter 58 so that no particulate powder enters the clean air chamber 52, or the atmosphere, through outlet 56. The blow back jet 60 is operated periodically and automatically to release a jet of air into the cartridge filter 58 toward the housing interior 22 to blow particulate powder material collected on the cartridge filter 58 back into the housing 12 where it falls into the fluidized bed of powder maintained above the fluidizing plate 26.

Figure 2:
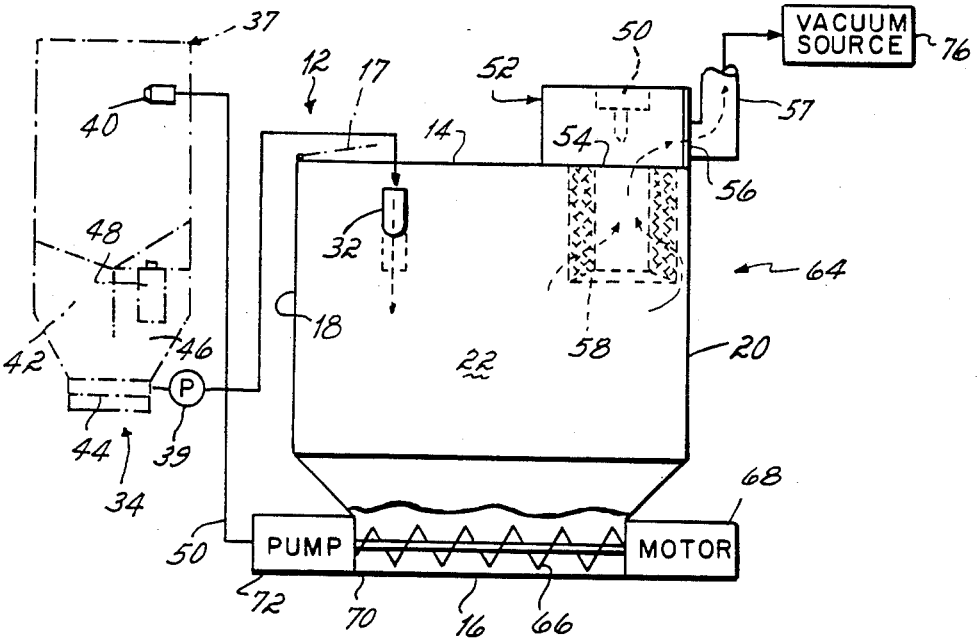
FIG. 2 is an alternative embodiment of the powder feeder apparatus herein employing a separate vacuum device, including a schematic illustration of a powder spray booth.

Referring now to FIG. 2, an alternative embodiment of a powder feeder of this invention is illustrated which is marked with the reference number 64. The powder feeder 54 is similar to cartridge feeder 10 in several respects, and those structural elements which are common to both embodiments are marked with the same reference numbers.

Powder feeder 64 is employed in powder coating applications which require a highly accurately metered quantity of particulate powder material to be transmitted to a powder dispenser. For this purpose, the fluidizing plate 26 of cartridge feeder 10 is eliminated in this embodiment and replaced with an anger or screw feeder 66. The screw feeder 66 is mounted within the interior 22 of housing 12, near the bottom wall 16, and is driven by a variable speed motor 68. The screw feeder 66 is rotatable to discharge metered quantities of particulate powder material through an outlet 70 formed in the base of housing 22. In turn, the outlet 70 may be connected to a powder pump 72 which receives the particulate powder mateial and entrains it within a stream of air for transmittal to a powder spray gun 40 in a powder spray booth 37 of the type illustrated in FIG. 1.

Air-entrained particulate powder material is introduced within the interior 22 of the housing 12 from the powder recovery system 34 of powder spray booth 37 through an inlet 32, as described in the FIG. 1 embodiment. The air introduced into the housing interior 22 with the particulate powder material creates a back pressure therein which must be vented. Venting of cartridge feeder 64 is accomplished with a clean air chamber 52 which is substantially identical in structure and operation to the clean air chamber 52 described above in connection with the powder feeder 10 illustrated in FIG. 1. The only difference with the clean air chamber 52 in this FIG. 2 embodiment, is that the fan 62 and motor 63 are replaced by a vacuum source 76 which is connected to the vent line 57 at the outlet 56 of clean air chamber 52. The vacuum source 76 can take the form of a vacuum pump or any other source of vacuum available.

While the invention has been described with reference to a preferred embodiment, it will be understood by those skilled in the art that various changes may be made and equivalents may be substituted for elements thereof without departing from the scope of the invention.

In addition, many modifications may be made to adapt a particular situation or material to the teachings of the invention without departing from the essential scope thereof. For example, the clean air chamber 52 illustrated with cartridge feeder 10 is interchangeable with the clean air chamber 52 shown with cartridge filter 64. In other words, either a fan 62 and motor 63, or external vacuum source 76, may be employed interchangeably in powder feeder 10 and powder feeder 64. Additionally, powder could be introduced into the cartridge feeders from a virgin powder source such as the device illustrated, for example, in U.S. Pat. No. 4,505,623.

Therefore, it is intended that the invention not be limited to the particular embodiment disclosed as the best mode contemplated for carrying out this invention, but that the invention will include all embodiments falling within the scope of the appended claims.

I claim:

1. Apparatus for feeding powder material to powder applicators mounted in a powder spray booth, said powder spray booth having a powder recovery system for collecting oversprayed powder material and a powder pump for pumping powder from said powder recovery system, said apparatus comprising:

a powder feed hopper having a housing formed with an interior having an inlet and an outlet, said inlet being adapted to be connected to said powder pump of said powder spray booth which transmits air-entrained powder material from said powder recovery system of said powder spray booth through said inlet and into said interior of said housing;

discharge means for collecting powder material ejected from said inlet into said interior of said housing and for discharging said collected powder material through said outlet of said housing, said discharge means being adapted to transmit powder material from said outlet to said powder applicators in said powder spray booth;

a clean air chamber mounted to said housing, said clean air chamber being formed with an inlet communicating with said interior of said housing and an outlet outside of said housing;

means communicating with said outlet of said clean air chamber for creating a negative pressure within said clean air chamber, said negative pressure drawing air from said interior of said housing through said inlet in said clean air chamber to vent said housing; and filter means mounted in the path of the air drawn through said inlet of said clean air chamber to filter powder material therefrom.

2. The apparatus of claim 1 in which said filter means comprises:

a cartridge filter mounted in said interior of said housing to said inlet of said clean air chamber, said cartridge filter collecting powder material from the air being drawn into said clean air chamber from said interior of said housing; and blow back means mounted in said clean air chamber for ejecting a jet of air onto said cartridge filter to return powder material collected on said cartridge filter into said interior of said housing.

3. The apparatus of claim 1 in which said discharge means comprises:

a fluidizing plate mounted in said interior of said housing, said fluidizing plate forming a fluidized bed of powder material transmitted through said inlet into said interior of said housing;

a powder pump connected to said outlet of said housing for withdrawing fluidized powder material from said fluidized bed in said interior of said housing, said powder pump being adapted to transmit said particulate powder material to said powder applicators in said powder spray booth.

4. The apparatus of claim 1 in which said discharge means comprises:

a feeder screw mounted in said interior of said housing, said feeder screw being rotatable to discharge metered quantities of particulate powder material through said outlet in said housing;

a powder pump connected to said outlet of said housing, said powder pump being adapted to transmit particulate powder material discharged through said outlet of said housing to said powder applicators in said powder spray booth.

5. Apparatus for feeding particulate powder material to powder applicators mounted in a powder spray booth, said powder spray booth having a powder recovery system for collecting oversprayed powder and a powder pump for pumping powder from said powder recovery system, said apparatus comprising:

a powder feed hopper having a housing formed with an interior having an inlet and an outlet, said inlet being adapted to be connected to said powder pump of said powder spray booth for transmitting air-entrained particulate powder material from said powder recovery system of said powder spray booth through said inlet into said interior of said housing;

a fluidizing plate mounted in said interior of said housing, said fluidizing plate forming a fluidized bed of particulate powder material transmitted through said inlet of said housing, said fluidized bed being adapted to be connected to said powder pump of said powder spray booth for discharge of particulate powder material from said fluidized bed, through said outlet in said interior of said housing and to said powder applicators mounted in said powder spray booth;

a clean air chamber mounted to said housing, said clean air chamber being formed with an inlet communicating with said interior of said housing and an outlet outside of said housing;

means communicating with said outlet of said clean air chamber for creating a negative pressure within said clean air chamber, said negative pressure drawing air from said interior of said housing through said inlet in said clean air chamber to vent said housing;

filter means mounted in the path of the air drawn through said inlet of said clean air chamber to filter powder material therefrom.

6. Apparatus for feeding particulate powder material to powder applicators mounted in a powder spray booth, said powder spray booth having a powder recovery system for collecting oversprayed powder and a powder pump for pumping powder from said powder recovery system, said apparatus comprising:

a powder feed hopper having a housing formed with an interior having an inlet and an outlet, said inlet being adapted to be connected to said powder pump of said powder spray booth for transmitting air-entrained particulate powder material from said powder recovery system of said powder spray booth through said inlet into said interior of said housing;

a screw feeder mounted in said interior of said housing, said screw feeder being rotatble to discharge metered quantities of particulate powder material from said interior of said housing through said outlet thereof, said outlet of said housing being adapted to be connected to said powder pump of said powder spray booth for transmitting air-entrained particulate powder material through said outlet and to said powder applicators mounted in said powder spray booth;

a clean air chamber mounted to said housing, said clean air chamber being formed with an inlet communcating with said interior of said housing and an outlet outside of said housing;

means communicating with said outlet of said clean air chamber for creating a negative pressure within said clean air chamber, said negative pressure drawing air from said interior of said housing through said inlet in said clean air chamber to vent said housing; and filter means mounted in the path of the air drawn through said inlet of said clean air chamber to filter powder material therefrom.

7. A powder spray system, comprising:

a powder spray booth, said powder spray booth having powder applicators mounted therein for spraying powder material and a powder recovery system for collecting oversprayed powder material;

a powder feed hopper including a housing formed with an interior having an inlet and an outlet;

a powder pump associated with said powder spray booth for pumping air-entrained powder material from said powder recovery system of said powder spray booth, through said inlet and into said interior of said housing;

discharge means for discharging powder material from said outlet in said interior of said housing to said powder applicators in said powder spray booth;

a clean air chamber mounted to said housing, said clean air chamber being formed with an inlet communicating with said interior of said housing and an outlet outside of said housing;

means communicating with said outlet of said clean air chamber for creating a negative pressure within said clean air chamber, said negative pressure drawing air from said interior of said housing through said inlet in said clean air chamber to vent said housing; and filter means mounted in the path of the air drawn through said inlet of said clean air chamber to filter powder material therefrom.

8. The apparatus of claim 7 in which said discharge means comprises:

a fluidizing plate mounted in said interior of said housing of said powder feed hopper, said fluidizing plate forming a fluidized bed of powder material transmitted through said inlet into said interior of said housing;

a powder pump connected to said outlet of said housing for withdrawing fluidized powder material from said fluidized bed in said interior of said housing, said powder pump transmitting powder material to said powder applicators in said powder spray booth.

9. The apparatus of claim 7 in which said discharge means comprises:

a feeder screw mounted in said interior of said housing of said powder feed hopper, said feeder screw being rotatable to discharge metered quantities of particulate powder material through said outlet in said housing;

a powder pump connected to said outlet of said housing, said powder pump transmitting powder material discharged through said outlet of said housing to said powder applicators in said powder spray booth.

10. Apparatus for feeding powder material to powder applicators, said apparatus comprising:

a powder feed hopper having a housing formed with an interior having an inlet and an outlet, said inlet being adapted to be connected to a source of powder;

discharge means for collecting powder material ejected from said inlet into said interior of said housing and for discharging said collected powder material through said outlet of said housing, said discharge means being adapted to transmit powder material to said powder applicators;

a clean air chamber mounted to said housing, said clean air chamber being formed with an inlet communicating with said interior of said housing and an outlet outside of said housing;

means communicating with said outlet of said clean air chamber for creating a negative pressure within said clean air chamber, said negative pressure drawing air from said interior of said housing through said inlet in said clean air chamber to vent said housing; and filter means mounted in the path of the air drawn through said inlet of said clean air chamber to filter powder material therefrom.

* * * * *